US010870208B2

(12) United States Patent
Gariboldi

(10) Patent No.: US 10,870,208 B2
(45) Date of Patent: Dec. 22, 2020

(54) FOLDING UTENSIL

(71) Applicants: Alberto Gariboldi, La Valletta Brianza (IT); Fiammetta Ravot, Cernusco Lombardone (IT)

(72) Inventor: Alberto Gariboldi, La Valletta Brianza (IT)

(73) Assignees: Alberto Gariboldi, La Valletta Brianza (IT); Fiammetta Ravot, Cernusco Lombardone (IT)

( * ) Notice: Subject to any disclaimer, the term of this patent is extended or adjusted under 35 U.S.C. 154(b) by 0 days.

(21) Appl. No.: 16/331,731

(22) PCT Filed: Sep. 6, 2017

(86) PCT No.: PCT/IB2017/055368

§ 371 (c)(1),
(2) Date: Mar. 8, 2019

(87) PCT Pub. No.: WO2018/047077

PCT Pub. Date: Mar. 15, 2018

(65) Prior Publication Data

US 2019/0202072 A1 Jul. 4, 2019

(30) Foreign Application Priority Data

Sep. 9, 2016 (IT) ..... 102016000091431

(51) Int. Cl.

| | |
|---|---|
| ***B26B 1/04*** | (2006.01) |
| ***B26B 1/10*** | (2006.01) |
| ***B26B 1/02*** | (2006.01) |

(52) U.S. Cl.

CPC ..... *B26B 1/04* (2013.01); *B26B 1/02* (2013.01); *B26B 1/10* (2013.01)

(58) Field of Classification Search

CPC ..... B26B 1/04; B26B 1/10

(Continued)

(56) References Cited

U.S. PATENT DOCUMENTS 4,612,706 A * 9/1986 Yunes ..... B26B 1/04 30/160
9,908,246 B2 * 3/2018 Frauenglass ..... B26B 1/02

(Continued)

FOREIGN PATENT DOCUMENTS

DE 10 2006 047 835 B3 1/2008

OTHER PUBLICATIONS

The International Search Report for corresponding Intl PCT Application No. PCT/IB2017/055368, two pages, dated Dec. 20, 2017.

(Continued)

*Primary Examiner* — Hwei-Siu C Payer
(74) *Attorney, Agent, or Firm* — Vorys, Sater, Seymour & Pease

(57) ABSTRACT

A folding utensil is provided including an active part defining a first longitudinal axis and configured to perform a folding utensil function; a handle defining a second longitudinal axis and including a seat for the active part; and an articulated quadrilateral loosely connecting the active part to the handle defining for the folding utensil a use configuration and a configuration of non-use and including two rocker arms hinged to the handle and to the active part so that the folding utensil passes from one configuration to another by varying the mutual inclination between the longitudinal axes.

6 Claims, 8 Drawing Sheets

(58) Field of Classification Search
USPC ..... 30/155
See application file for complete search history.

(56) References Cited

U.S. PATENT DOCUMENTS

| | | | | |
|---|---|---|---|---|
| 10,189,169 | B2 * | 1/2019 | Varner | B26B 9/00 |
| D865,480 | S * | 11/2019 | Caswell | B26B 1/00 D8/99 |
| 2006/0230620 | A1 | 10/2006 | Steigerwalt et al. | |
| 2007/0124940 | A1 | 6/2007 | Hawk et al. | |
| 2013/0212886 | A1 | 8/2013 | Hawk et al. | |
| 2018/0154531 | A1 * | 6/2018 | Caswell | B26B 1/00 |
| 2019/0202072 | A1 * | 7/2019 | Gariboldi | B26B 1/02 |

OTHER PUBLICATIONS

The Italian Search Report for corresponding Italian Application No. 201600091431, 2 pages, completed on Jul. 13, 2017.

* cited by examiner

*Fig. 4a*
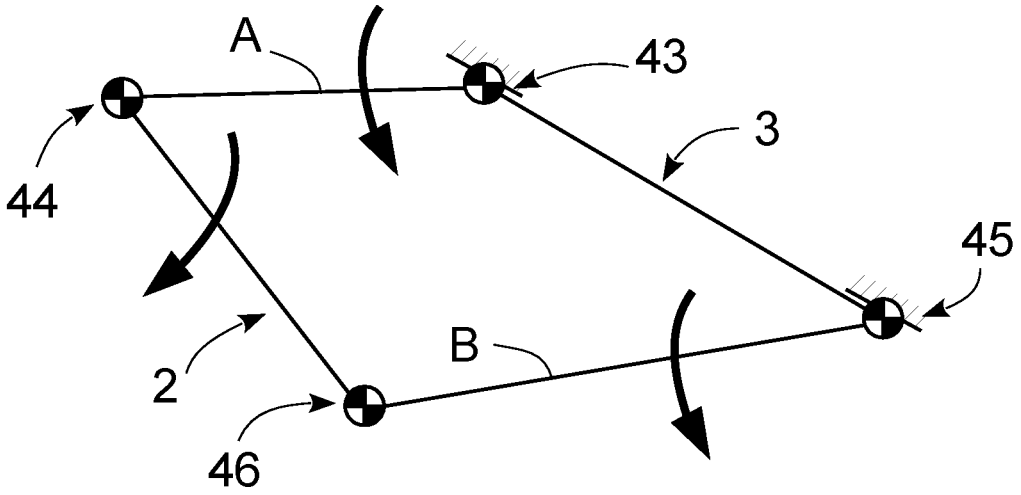
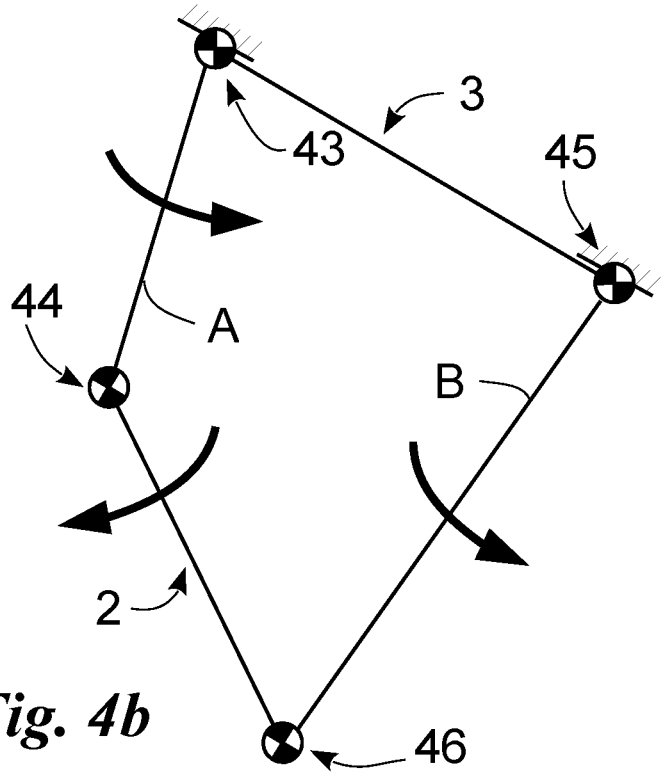
*Fig. 4b*

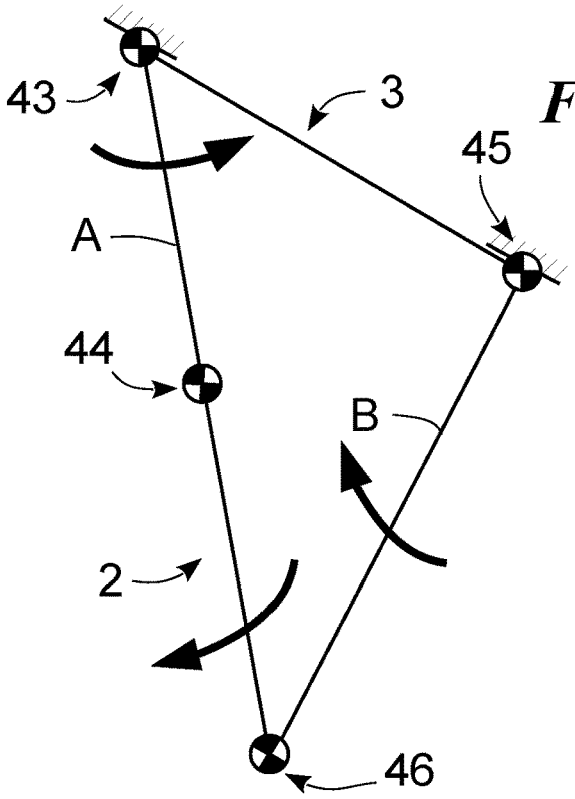
*Fig. 4c*
*Fig. 4d*
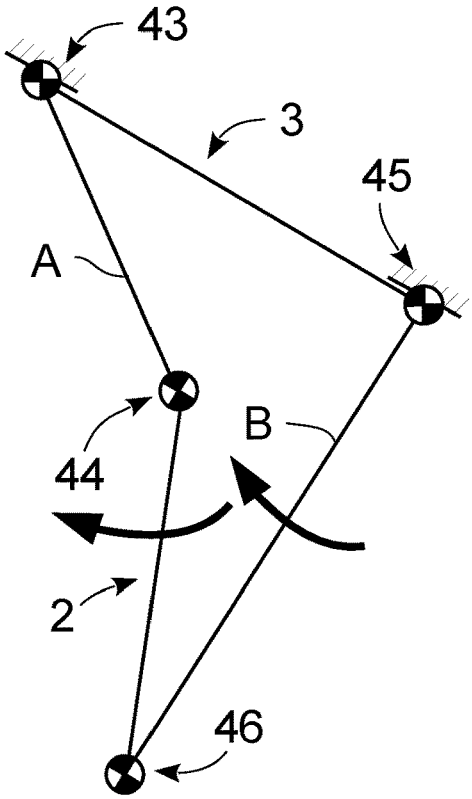
*Fig. 4e*
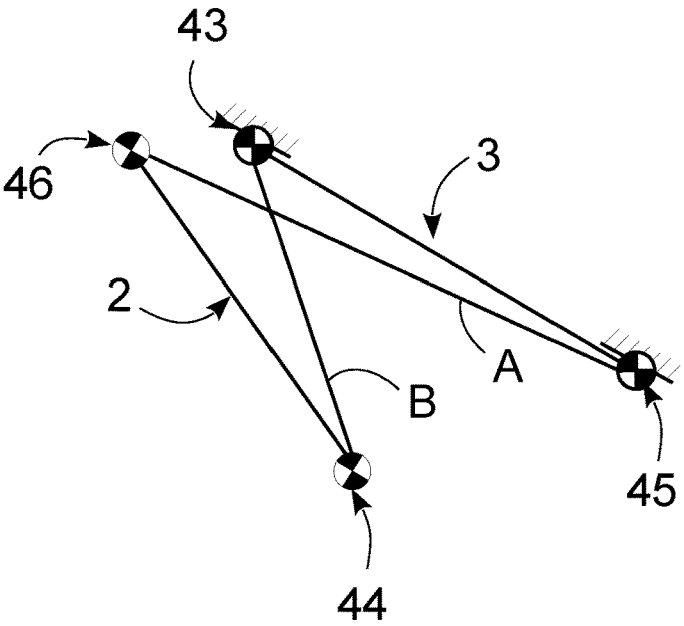

FOLDING UTENSIL

The present invention relates to a folding utensil of the type as recited in the preamble of the first claim.

The object of the present invention is a utensil comprising a handle and an active part (identifiable, for example in a blade, a laser pointer, a corkscrew or other) movable with respect to the handle so as to assume a configuration of use in which the active part is external to the handle allowing use of the utensil and a configuration of non-use in which the active part is inserted in the handle seat preventing the use of the utensil.

As is known, one of the most common folding utensils are folding knives also called jack knives.

These knives have, in addition to the handle and the blade identifying the active part of the utensil, a pin hinging the blade and handle so that by rotating the blade is inserted in the handle concealing the cutting edge.

In the configuration of non-use, the active part being almost entirely housed in the handle, folding knives, as well as the other folding utensils have a small portion of the active part formed, in the case of a knife, on the back of the blade, in view and equipped with a grip incision for the user.

The prior art mentioned above has several significant drawbacks.

A first drawback lies in the fact that the folding utensils, while presenting dimensions inferior to non-folding utensils, continue to have large dimensions due to the need to conceal the entire active part. The dimensions of the handle, in particular, are significant and equal to or greater than the dimensions of the blade or utensil.

It is to be noted how, these utensils being created to respond to a demand for small utensils and easily transportable utensils, this drawback is relevant.

Another important drawback of the folding utensils is presented by the difficulty of opening given by the limited active part portion in view when the utensil is in the closed configuration.

To resolve this problem special snap folding utensils have been devised.

These folding utensils are provided with a spring which, in the transition to the non-use configuration, is compressed and a catch that locks the spring when compressed. At the transition to a configuration of use the user presses a button which commands the removal of the catch releasing the spring that pushes the active part outside the handle.

However, snap folding utensils may open accidentally, which especially in the case of jack knives is dangerous.

Another drawback is the fact that said folding utensils have very fragile opening and closing mechanisms.

U.S. Patent Application Publication No. 2007/0124940 describes a utensil which obviates only in part said drawbacks and is very complex and unwieldy.

In this situation the technical purpose of the present invention is to devise a folding utensil able to substantially overcome the drawbacks mentioned above.

Within the sphere of said technical purpose one important aim of the invention is to provide a folding utensil having reduced dimensions which is easy to open.

Another important aim of the invention is to obtain a folding utensil which is practical and safe to use.

The characteristics and advantages of the invention are clearly evident from the following detailed description of a preferred embodiment thereof, with reference to the accompanying drawings, in which.

Figure 1:
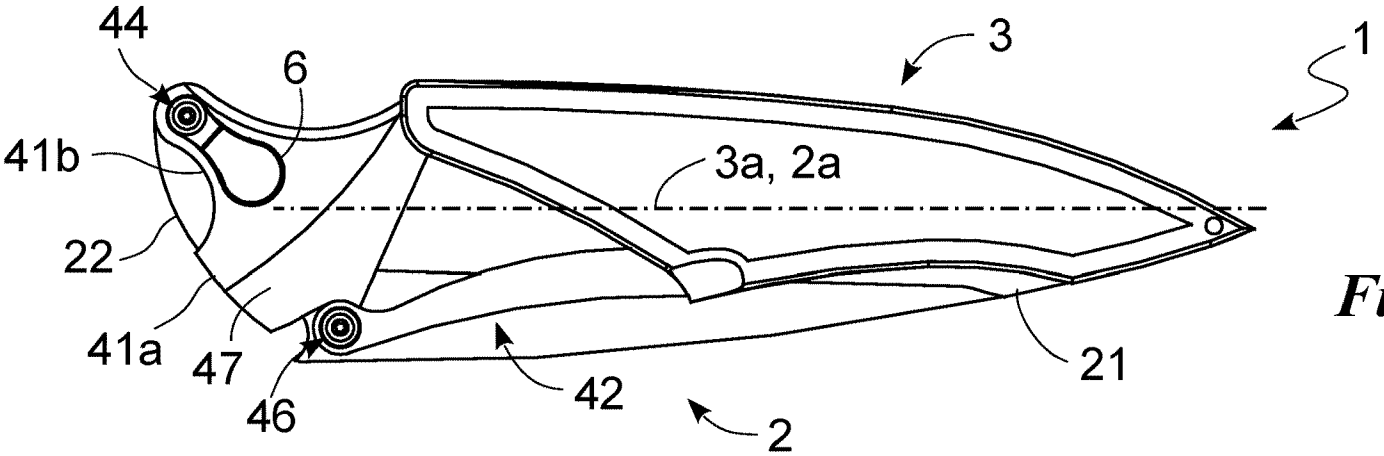
FIG. 1 shows a folding utensil according to the invention.
Figure 2:
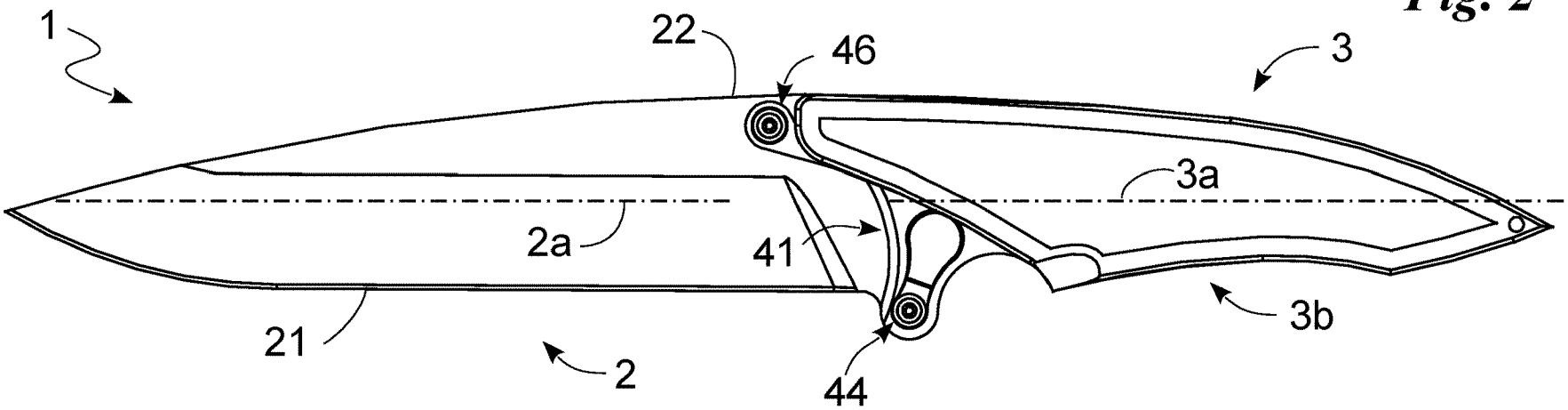
FIG. 2 is the folding utensil in FIG. 1 in a different configuration.

FIGS. 3*a*-3*e* show the transition of the folding utensil from the configuration in FIG. 1 to the configuration in FIG. 2 and FIGS. 4*a*-4*e* schematise a folding utensil assembly during the transition from the configuration of FIG. 1 to the configuration in FIG. 2.

Herein, the measures, values, shapes and geometric references (such as perpendicularity and parallelism), when used with words like "about" or other similar terms such as "approximately" or "substantially", are to be understood as except for measurement errors or inaccuracies due to production and/or manufacturing errors and, above all, except for a slight divergence from the value, measure, shape or geometric reference which it is associated with. For example, said terms, if associated with a value, preferably indicate a divergence of not more than 10% of said value.

In addition, where used terms such as "first", "second", "upper", "lower", "main" and "secondary" do not necessarily refer to an order, a priority relationship or relative position, but may simply be used to more clearly distinguish different components from each other.

With reference to said drawings, reference numeral 1 globally denotes the folding utensil according to the invention.

It is identifiable, for example in a knife, a laser pointer, a corkscrew, a fork, a spoon, a USB stick, a hacksaw or other utensil suitable to define a use configuration (FIGS. 2, 3*e*, 4*e*) in which it is possible to use the utensil 1 and a configuration of non-use (FIGS. 1, 3*a*, 4*a*) in which it is not possible to use the utensil 1. In some cases, the folding utensil 1 defines an additional configuration of an intermediate use between the configuration of use and the configuration of non-use.

Preferably, the folding utensil 1 is a folding knife.

The folding utensil 1 comprises an active part 2 defining a first longitudinal axis 2*a* and suitable to perform a function such as, for example, cutting; a handle 3 defining a second longitudinal axis 3*a*; an articulated quadrilateral 4 loosely connecting the active part 2 to the handle 3.

Said longitudinal axes 2*a* and 3*a* are preferably barycentric.

The active part 2 comprises a functional body 21 identifying the active part portion 2 suitable to carry out a folding utensil function 1; and a base body 22 engaging to the handle 3 and appropriately suitable to be placed between the active part 21 and a handle 3 in the use configuration.

The functional body 21 extends substantially along the longitudinal axis 2*a*.

It is integral with the base body 22 and suitably made in one piece with the base body 22.

The functional body 21 is identifiable in a helical element in the case of a utensil 1 consisting of a corkscrew; in a laser emitter in the case of a utensil 1 identifiable in a laser pointer; in a trident in the case of a folding utensil 1 identifiable in a fork; or in a blade in the case of a utensil 1 identifiable in a knife or a hacksaw.

Preferably, the utensil 1 is a folding knife, the functional body 21 is a blade and the base body 22 may represent the node (also called tang) of said blade.

The base body 22 may comprise an abutment cavity 22*a* for the handle 3 when the folding utensil 1 is in the use configuration.

In addition, the base body 22 may comprise a protuberance perpendicular to the first longitudinal axis 2*a* extending beyond the functional body 21 so as to identify, in the case of a utensil 1 identifiable in a knife, the branch/guard arm of the knife. The handle 3 has a length, measured along the second longitudinal axis 3*a*, less than the length of the active part 2 calculated along the first longitudinal axis 2*a*. It comprises a seat 3*b* for at least part of said active part 2 and, preferably, of the articulated quadrilateral 4.

The seat 3*b* is substantially counter-shaped to the active part portion 2 and, to be precise, of the functional body 21 available in it in a configuration of non-use. Consequently, only the functional body 21 is suitable to be housed in the seat 3*b*, while the base body 22 remains outside.

Suitably, the handle 3 comprises an abutment tooth 3*c* suitable to abut with the base body 22 and, to be precise, with the abutment cavity 22*a* when the folding utensil 1 comes into the use configuration.

The articulated quadrilateral 4 connects the active part 2 to the handle 3 allowing the folding utensil 1 to move from one configuration to the other by varying, during said transition, the inclination between the axes 2*a* and 3*a*.

In the configuration of non-use, the functional body 21 is at least partially inserted, suitably almost entirely, in the seat 3*b* and the longitudinal axes 2*a* and 3*a* may diverge from each other by an angle substantially smaller than 10°, in detail 5°, in more detail be almost parallel to each other. Suitably in said configuration of non-use the base body 22 is external to the seat 3*b*.

In the use configuration the functional body 21 is external to the seat 3*b* and the first longitudinal axis 2*a* and the longitudinal axes 2*a* and 3*a* may diverge from each other by an angle substantially less than 10°, in detail 5° in more detail can be almost parallel to each other.

In the possible additional configuration of use the functional body 21 is external to the seat 3*b* and the longitudinal axes 2*a* and 3*a* are mutually transverse. To be precise, in this configuration the axes 2*a* and 3*a* may diverge from each other by an angle substantially comprised between 60° and 90°, in detail, between 75° and 90° and in more detail, be almost perpendicular to each other.

The articulated quadrilateral 4 may comprise at least one upper rocker arm 41 hinged to the handle 3 and to the active part 2 and at least one lower rocker arm 42 hinged to the handle 3 and the active part 2 so as to allow the folding utensil 1 to switch between the possible configurations (of use, non-use and any additional configurations of use) by varying the mutual inclination between the longitudinal axes 2*a* and 3*a*.

Preferably, the articulated quadrilateral 4 comprises two pairs of upper 41 and lower rocker arms 42 placed on the opposite side to the active part 2.

For each pair of rocker arms 41 and 42 the quadrilateral 4 may comprise a first hinge 43 defining a first axis of rotation between the upper rocker arm 41 and handle 3 (appropriately made on the abutment tooth 3*c*); a second hinge 44 defining a second axis of rotation between the upper rocker arm 41 and the active part 2 and, to be precise, the base body 22; a third hinge 45 defining a third axis of rotation between the lower rocker arm 42 and handle 3; and a fourth hinge 46 defining a fourth axis of rotation between the lower rocker arm 42 and the active part 2 and, to be precise, the base body 22 and more precisely between the lower rocker arm 42 and said projection of the base body 22.

The rocker arms 41 and 42 lie, with respect to the rotation axes, on different planes so as to be overlapped along said axes of rotation.

The axes of rotation are parallel to each other.

The second 44 and the fourth hinge 46 are arranged on opposite sides with respect to the first longitudinal axis 2*a*. In detail, in the case of a utensil 1 identified in a folding knife, the second hinge 44 is on the base body 22 and next to the back of the blade and the fourth hinge 46 is on the base body 22 and next to the cutting edge of the blade.

The first hinge 43 and the third hinge 45 are on opposite sides with respect to the second longitudinal axis 2*a*. In detail, the first hinge 43 is next to the abutment tooth 3*c*.

The distance between the first 43 and second hinge 44 and, therefore, between the first and second axis of rotation is different and, suitably, less than the distance between third 45 and fourth hinge 46 i.e. between the third and fourth axis of rotation. To be precise the distance between the hinges 43 and 44 is almost less than 80% and, in detail, substantially comprised between 50% and 80%, in detail, between 60% and 70% and suitably substantially equal to 65% of the distance between the hinges 45 and 46.

Consequently, the upper rocker arm 41 also has a different length and, in detail, less than the length of the lower rocker arm 42.

The distance between the first hinge 43 and third hinge 45 and, therefore, between the first and third axis of rotation is different and, in particular, greater than the distance between the second 44 and fourth hinge 46, i.e. between the second and fourth axis of rotation. Appropriately, the distance between the hinges 43 and 45 is substantially comprised between 110% and 140%, in detail, between 120% and 130%, more in detail, and appropriately almost equal to 125% of the distance between the second hinge 44 and fourth hinge 46.

The distance between the first hinge 43 and second hinge 44, therefore, between the first and second axis of rotation is different and, in particular, less than the distance between the first 43 and third hinge 45 i.e. between the first and third axis of rotation. Suitably, the distance between the hinges 43 and 44 is virtually comprised between 60% and 90%, in detail, between 70% and 80% and suitably almost equal to 74% of the distance between the hinges 43 and 45.

Summarizing, the distance between the hinges 43 and 44 is less than the distance between the hinges 45 and 46 and the distance between the hinges 43 and 45 which in turn is greater than the distance between the hinges 44 and 46. In detail, the distance between the hinges 43 and 44 is substantially comprised between 50% and 80% of the distance between the hinges 45 and 46 and between 60% and 90% of the distance between the hinges 43 and 45 which in turn is substantially comprised between 110% and 140% of the distance between the hinges 44 and 46. More in detail, the distance between the hinges 43 and 44 is substantially comprised between 60% and 70% of the distance between the hinges 45 and 46 and between 70% and 80% of the distance between the hinges 43 and 45 which in turn is substantially comprised between 120% and 130% of the distance between the hinges 44 and 46. Preferably, the distance between the hinges 43 and 44 is substantially equal to 65% of the distance between the hinges 45 and 46 and equal to 74% of the distance between the hinges 43 and 45 which in turn is substantially equal to 125% of the distance between the hinges 44 and 46.

The articulated quadrilateral 4 is summarized in FIGS. 4*a*-4*e* where the frame is to be identified in the handle 3, the connecting rod is represented by the active part 2; the upper segment A joining the hinges 43 and 44 schematizes the upper rocker arm 41; and; the lower segment B joining the hinges 45 and 46 schematizes the lower rocker arm 42.

The articulated quadrilateral 4 in the configuration of non-use is identifiable in a parallelogram (schematic diagram of FIG. 4*a*) where the upper segment A does not cross (does not overlap) the lower segment B, i.e. with the upper rocker arm 41 not crossing (not overlapping) the lower rocker arm 42; whereas in the use configuration the articulated quadrilateral 4 identifies an anti-parallelogram (schematic diagram of FIG. 4*e*) in which the upper segment A crosses (overlaps) the lower segment B, i.e. with the upper rocker arm 41 crossing (overlapping) the lower rocker arm 42.

To switch from a parallelogram to an anti-parallelogram or vice versa, the articulated quadrilateral 4 may determine a change, suitably in succession, of motion of at least one, and preferably both the rocker arms 41 and 42. Such change of motion is achievable for example by stopping or inverting the direction of advancement obtainable thanks to a dead point, namely a configuration in which at least three axes of rotation are aligned.

Preferably, the articulated quadrilateral 4 can determine the inversion of motion of the lower rocker arm 42 and stop the motion of the upper rocker arm 41.

The inversion of motion of the lower rocker arm 42, i.e. the lower segment B, is when the articulated quadrilateral 4 passes through a dead point where the first, third and fourth axes of rotation are aligned. Such dead point is schematically represented in FIG. 4*c* which highlights the alignment of the upper segment A to the line joining the hinges 46 and 44, i.e. to the active part 2.

Figure 3A:
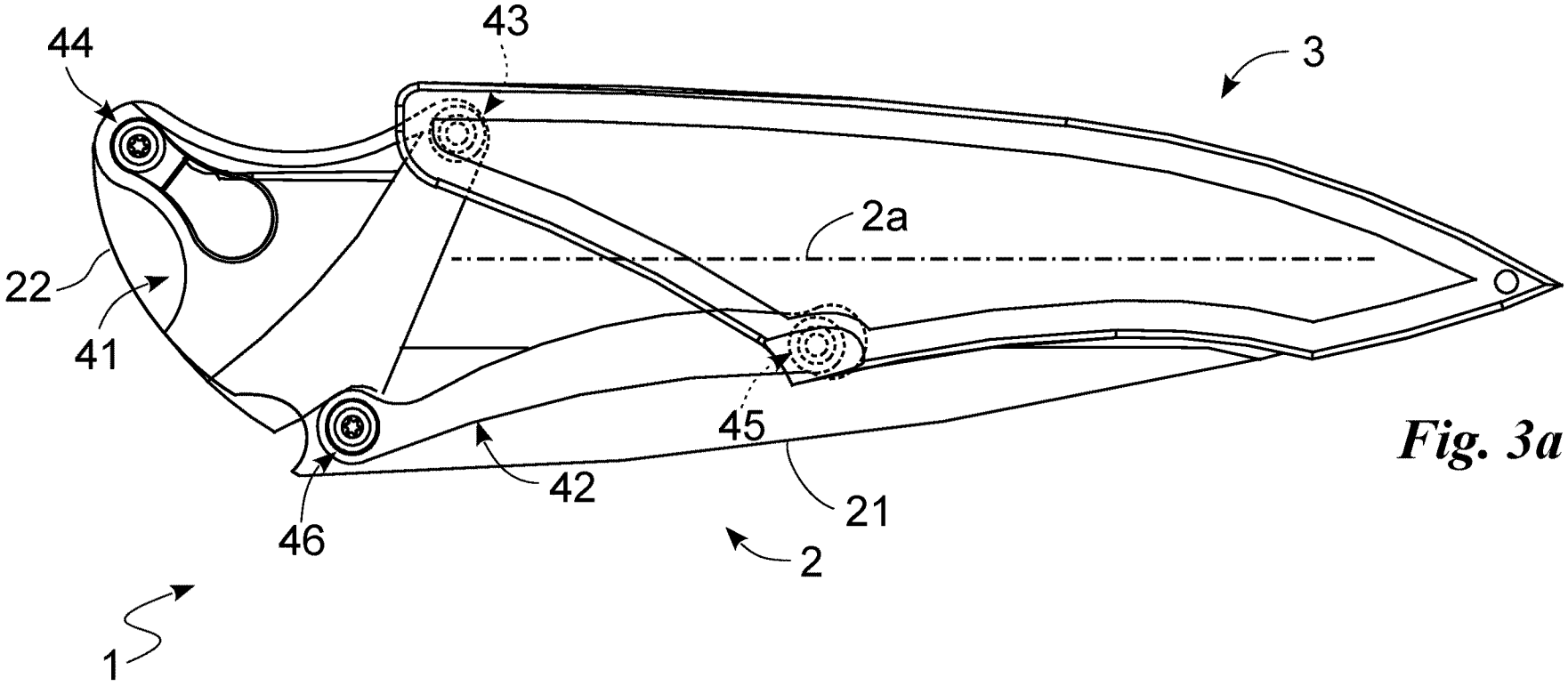
Figure 3B:
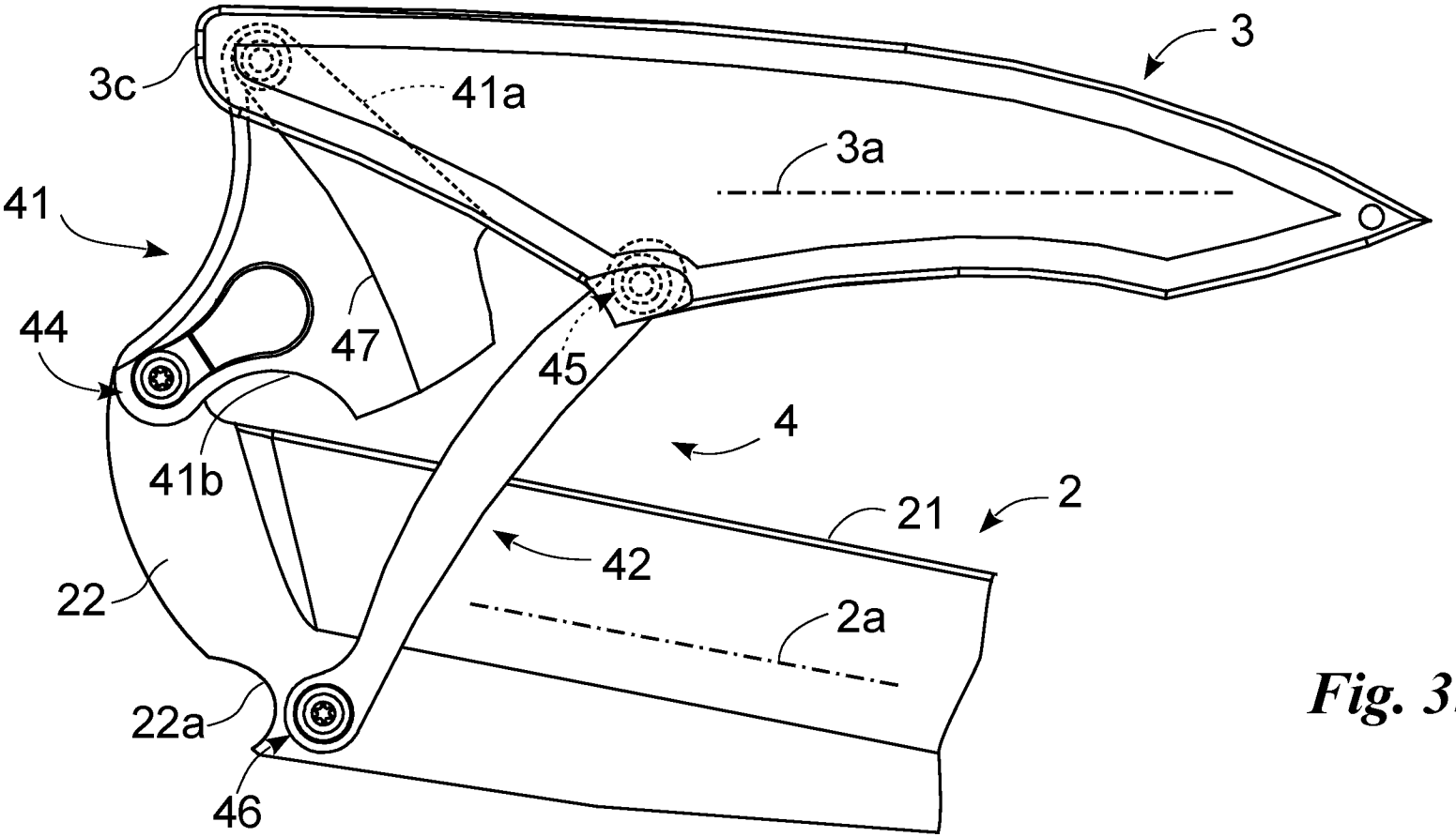
Figure 3C:
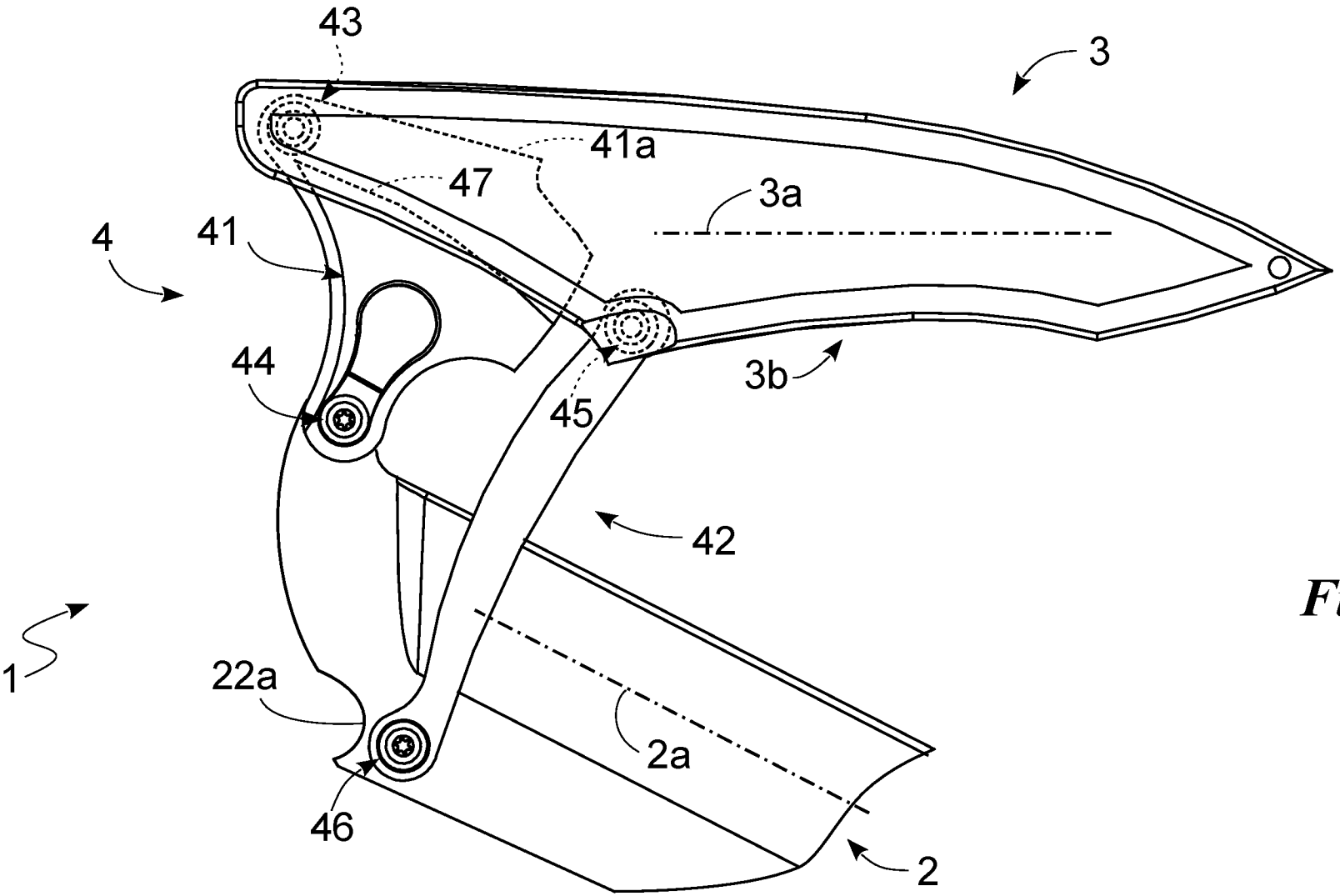
Figure 3D:
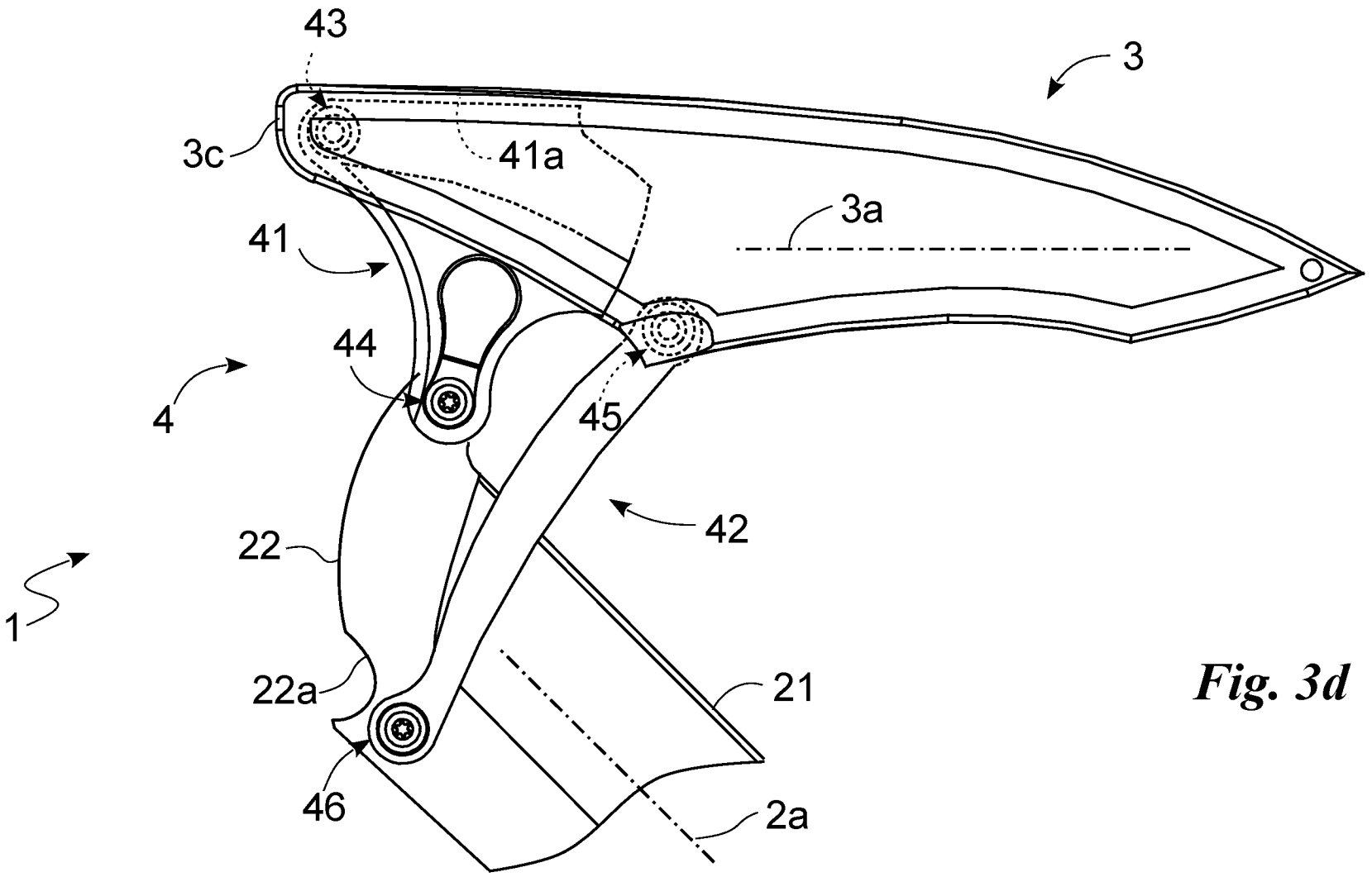
Figure 3E:
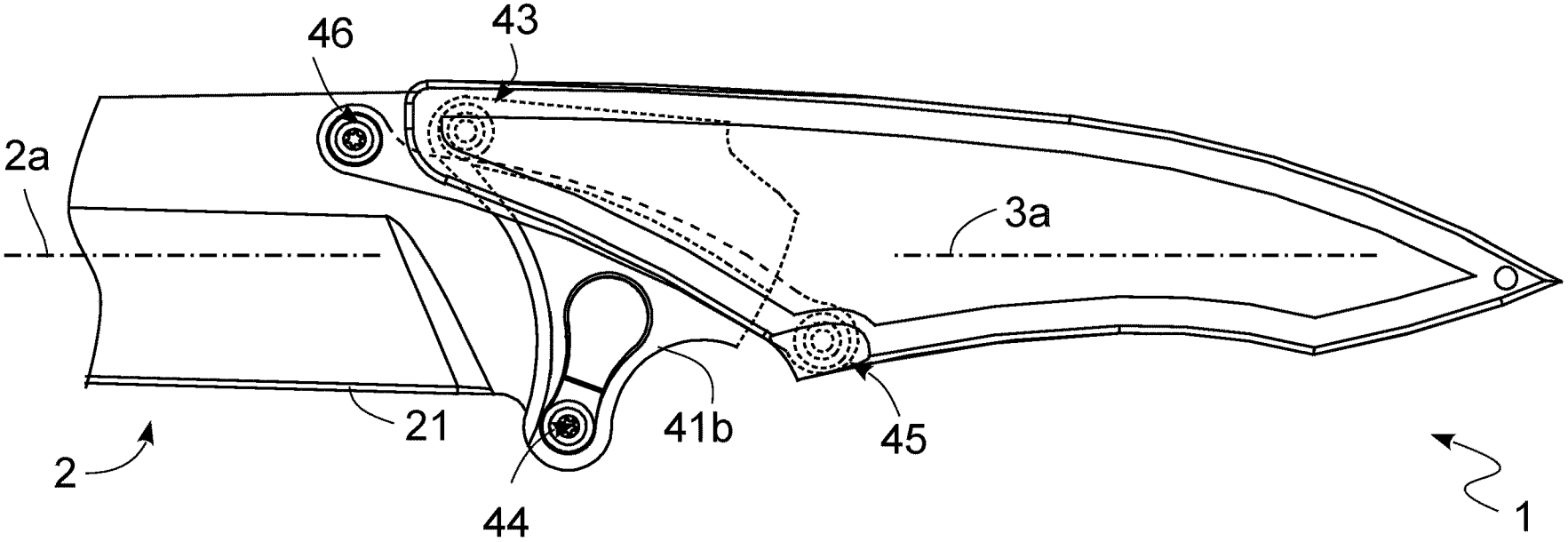

The arrest of motion of the upper rocker arm 41 is achievable by bringing the upper rocker arm 41 in abutment with the handle 3 and, to be precise, with the bottom of the seat 3*b* (FIG. 3*d*).

It should be noted how, optionally, the arrest of the upper rocker arm 41 may be followed by a motion of the same upper rocker arm 41 in the opposite direction to that prior to the arrest.

Alternatively, the articulated quadrilateral 4 can move from a parallelogram to an anti-parallelogram or vice versa thanks to an inversion of motion of the lower rocker arm 42 and the upper rocker arm 41.

In this case, in addition to the dead point described above, the articulated quadrilateral 4 passes through an additional dead point where the first, second and fourth axes of rotation (i.e. the hinges 43, 44 and 46) are aligned thus determining an inversion of the advancement of the upper rocker arm 41. In the additional dead point the lower segment B and the line joining the hinges 43 and 45, namely to the handle 3 are aligned.

The upper rocker arm 41 is suitable to at least partially fit into the seat 3*a*.

It may be substantially a polygonal shape (for example triangular) and have the hinges 43 and 44 at two vertices.

The upper rocker arm 41 defines a support side 41*a* at the bottom of the seat 3*b*, i.e. one side subtended between the first hinge 43 and vertex devoid of hinges adjacent to said first hinge 43, suitable to abut against the bottom of the seat 3*b* limiting the stroke of said upper rocker arm 41.

Furthermore, at least in the case of a utensil 1 identifiable in a knife, the upper rocker arm 41 may comprise a grip side 41*b* subtended between the second hinge 44 and vertex devoid of hinges adjacent to said second hinge 44 and suitable to define a branch of the guard of the knife when the utensil is in the use configuration.

The lower rocker arm 42 is suitable to at least partially fit into the seat 3*b*.

It has an arched profile and, suitably, a double-curved or S profile.

Lastly, the articulated quadrilateral 4 may comprise a catch 47 suitable to limit the stroke of the lower rocker arm 42 abutting with it when the folding utensil 1 comes into the use configuration.

Said catch 47 is integral with the upper rocker arm 41 and suitably placed in correspondence of the first hinge 43.

In some cases, the folding utensil 1 may comprise a stop device 6 suitable to lock the folding utensil 1 in the configuration of use and, if present, in the additional configuration of use.

It is to be noted how the locking of the folding utensil 1 in the use configuration and, if present, in the additional configuration of use is obtained by blocking the lower rocker arm 42 between the catch 47 and the stop device 6 thus preventing a reciprocal motion between the rocker arms 41 and 42.

The stop device 6 may be connected to the first rocker arm 41 and suitable to define a contracted configuration in which it is housed in the first rocker arm 41 so as to allow a reciprocal sliding between the rocker arms 41 and 42 and, in correspondence with the use configuration, and if present, the additional use configuration, an expanded configuration in which it protrudes from the first rocker arm 41 preventing a reciprocal sliding between the rocker arms 41 and 42.

The functioning of a folding utensil, described above in the structural sense, defines an innovative opening method of a folding utensil which can be implemented by said folding utensil 1.

The method of use, shown schematically in FIGS. 3*a*-3*e*, is suitable to be controlled by a mutual displacement between the active part 2 and the handle 3 defined by the articulated quadrilateral 4 and comprises an initial phase of movement in which the active part 2 is moved relative to the handle 3 and the rocker arms 41 and 42 rotate, relative to the handle 3, suitably in the same direction; an intermediate phase of movement in which the active part 2 is moved relative to the handle 3 without changing the direction of advancement and only one of the rocker arms 41 and 42 stops and/or inverts the direction of advancement; and a final phase of movement in which the active part 2 is moved relative to the handle 3 without changing the direction of advancement while the other rocker arm 41 and 42 also stops and/or inverts the direction of advancement.

Optionally, the method of use may lastly comprise a step of locking in which the stop device 6 locks the lower rocker arm 42 against the catch 47 preventing a reciprocal motion between the rocker arms 41 and 42.

By way of example the method of use in case of transition into a use configuration is described. The transition into the configuration of non-use is substantially opposite to the transition into a use configuration.

Initially, the folding utensil 1 is in the configuration of non-use and the method of use provides that in the initial movement phase (FIGS. 3*a*-3*c* and 4*a*-4*c*) the active part 2 roto-translates until the articulated quadrilateral 4 reaches the dead point (FIGS. 3*c* and 4*c*).

In this phase the upper rocker arm 41 and the lower rocker arm 42 rotate relative to the handle 3 in approximately the same direction but opposite to that of the active part 2.

Appropriately, in the initial movement phase the inclination between the longitudinal axes 2*a* and 3*a* is varied.

Upon reaching the dead point, the intermediate movement phase begins (FIGS. 3*c*-3*d* and 4*c*-4*d*) in which the active part 2 and the upper rocker arm 41 rotate relative to the handle 3 without changing direction while the lower rocker arm 42, the quadrilateral having passed the dead point, rotates relative to the handle 3 in a direction opposite to that of the initial phase of movement.

In conclusion, in the intermediate movement phase the upper rocker arm 41 and the active part 2 move in the same direction to each other, but opposite that of the lower rocker arm 42.

Appropriately, in the intermediate movement phase the inclination between the longitudinal axes 2*a* and 3*a* is varied.

The intermediate movement phase is completed when the support side 41*a* comes into contact with the bottom of the seat 3*b*.

Thus, the final movement phase begins (FIGS. 3*d*-3*e* and 4*d*-4*e*) in which the upper rocker arm 41 stops its stroke while the active part 2 and the lower rocker arm 42 continue to rotate relative to the handle 3 without changing direction until the folding utensil 1 is in the use configuration.

In some cases, prior to reaching the use configuration, the upper rocker arm 41 may, after the arrest, rotate relative to the handle 3 in a direction opposite to that of the intermediate movement phase.

The use configuration is obtained when the abutment tooth 3*c* abuts with the abutment cavity 22*a* and/or the lower rocker arm 42 strikes against the catch 47. Alternatively, the intermediate movement phase is completed upon reaching the additional dead point. In this case, in the subsequent final movement phase in which the upper rocker arm 41 rotates relative to the handle 3 in the direction opposite to the direction of rotation in the intermediate movement phase while the lower rocker 42 rotates relative to the handle 3 in the same direction to that of the intermediate movement phase.

Upon completion of the final movement phase the folding utensil 1 is in the configuration of use.

At this point the method of use may provide for the locking phase in which the stop device 6 locks the lower rocker arm 42 against the catch 47 preventing a reciprocal motion between the rocker arms 41 and 42.

The invention achieves important advantages.

A first advantage lies in the fact that the folding utensil 1 has, for equal dimensions of the functional body 21 (in particular in the case of the blade), very reduced dimensions with respect to the folding utensils known up to today.

This aspect has been innovatively obtained thanks to the particular articulated quadrilateral 4 which, by placing only the functional body 21 inside the handle 3, allows a reduction of the size of the handle 3, and thus of the folding utensil 1.

Another advantage is therefore represented by the transportability which characterizes the folding utensil 1.

Another advantage is the simplicity of opening the folding utensil 1.

In fact, by presenting in the configuration of non-use the base body 22 external to the handle 3, it allows an easy gripping of the functional part and, therefore, a convenient handling of the same.

A further advantage is that the utensil 1, having a plurality of pins and hinges is very robust compared to those of the prior art.

Variations may be made to the invention without departing from the scope of the inventive concept described in the independent claims and in the relative technical equivalents. In said sphere all the details may be replaced with equivalent elements and the materials, shapes and dimensions may be as desired.

The invention claimed is:

1. A folding utensil, comprising:

an active part defining a first longitudinal axis and configured to perform a function of said folding utensil;

a handle defining a second longitudinal axis and comprising a seat for at least part of said active part;

an articulated quadrilateral loosely constrained to said active part at said handle defining for said folding utensil a configuration of use and a configuration of non-use;

and wherein said articulated quadrilateral comprises two rocker arms each hinged to said handle and to said active part and the two rocker arms overlapping each other when said active part is moved between said configurations so that said active part is moved between said configurations by varying the mutual inclination of said longitudinal axes.

2. The folding utensil according to claim 1, wherein said two rocker arms comprise an upper rocker arm and a lower rocker arm, wherein in said configuration of non-use said upper rocker arm does not overlap said lower rocker arm so that said articulated quadrilateral is a parallelogram and in said configuration of use said upper rocker arm overlaps said lower rocker arm so that said articulated quadrilateral is an anti-parallelogram.

3. The folding utensil according to claim 1, wherein said two rocker arms comprise an upper rocker arm and a lower rocker arm, wherein said articulated quadrilateral comprises a first hinge hinging said upper rocker arm to said handle, a second hinge hinging said upper rocker arm to said active part, a third hinge hinging said lower rocker arm to said handle and a fourth hinge hinging said lower rocker arm to said active part; wherein the distance between said first hinge and said second hinge is less than the distance between said third hinge and said fourth hinge and the distance between said first hinge and said third hinge; wherein the distance between said first hinge and said third hinge is greater than the distance between said second hinge and said fourth hinge.

4. The folding utensil according to claim 3, wherein said distance between said first hinge and said second hinge is substantially comprised between 60% and 70% of said distance between said third hinge and said fourth hinge and between 70% and 80% of said distance between said first hinge and said third hinge; and wherein said distance between said first hinge and said third hinge is substantially comprised between 120% and 130% of said distance between said second hinge and said fourth hinge.

5. The folding utensil according to claim 3, wherein said longitudinal axes are barycentric; wherein said second hinge and said fourth hinge are placed on opposite sides with respect to said first longitudinal axis; and wherein said first hinge and said third hinge are on opposite sides with respect to said second longitudinal axis.

6. A method of using said folding utensil according to claim 1, comprising:

a phase of initial movement in which said active part is moved with respect to said handle and said rocker arms rotate varying the inclination between said longitudinal axes;

a phase of intermediate movement in which said active part is moved with respect to said handle without changing the direction of advancement with respect to said initial phase of movement and in which only one of said rocker arms stops or reverses the direction of advancement; and a phase of final movement in which the active part is moved relative to the handle without changing the direction of advancement while also the other of said rocker arms stops and/or reverses the direction of advancement.

* * * * *